US011493861B2

(12) United States Patent
Hayashi

(10) Patent No.: US 11,493,861 B2
(45) Date of Patent: Nov. 8, 2022

(54) DEVELOPER CONTAINER AND IMAGE FORMING APPARATUS HAVING THE SAME

(71) Applicant: KYOCERA Document Solutions Inc., Osaka (JP)

(72) Inventor: Koichi Hayashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/535,824

(22) Filed: Nov. 26, 2021

(65) Prior Publication Data

US 2022/0171310 A1 Jun. 2, 2022

(30) Foreign Application Priority Data

Dec. 2, 2020 (JP) ..... JP2020-200102

(51) Int. Cl.
*G03G 15/08* (2006.01)

(52) U.S. Cl.
CPC ..... *G03G 15/0889* (2013.01); *G03G 15/0891* (2013.01)

(58) Field of Classification Search
CPC ..... G03G 15/0822; G03G 15/0887; G03G 15/0889; G03G 15/0891; G03G 15/0893
See application file for complete search history.

(56) References Cited

U.S. PATENT DOCUMENTS 9,529,304 B2 * 12/2016 Uesugi ..... G03G 15/08
10,474,066 B1 * 11/2019 Tatsumi ..... G03G 15/0891

FOREIGN PATENT DOCUMENTS

JP 2013-246268 12/2013

* cited by examiner

*Primary Examiner* — Hoang X Ngo
(74) *Attorney, Agent, or Firm* — Lex IP Meister, PLLC

(57) ABSTRACT

In a developer container, a rotating shaft is rotatably supported by a casing and is rotationally driven. A flexible member has a leading edge portion which is connected to the rotating shaft and turns through a region extending over a supply port on an inner lower surface of the casing when the flexible member is rotated in association with the rotating shaft. A rotating plate is formed to project in a handguard-shape from a portion of the rotating shaft adjacent to the flexible member, has an outer edge portion along an edge of the supply port, and rotates in association with the rotating shaft.

5 Claims, 5 Drawing Sheets

DEVELOPER CONTAINER AND IMAGE FORMING APPARATUS HAVING THE SAME

INCORPORATION BY REFERENCE

This application is based upon and claims the benefit of priority from the corresponding Japanese Patent Application No. 2020-200102 filed on Dec. 2, 2020 the entire contents of which are incorporated herein by reference.

The present disclosure relates to a developer container and an image forming apparatus having a structure that prevents bridging of developer.

BACKGROUND

In an electrophotographic image forming apparatus, a developer container supplies a developer to a developing unit, which develops an electrostatic latent image on a surface of a photosensitive member. The developer container includes a casing having a supply port communicating with the developing unit formed on a lower surface thereof, and a rotating body arranged in the casing and driven to rotate.

When the rotating body rotates, the developer is conveyed to the supply port and supplied to the developing unit through the supply port. For example, the rotating body includes a shaft member and a flexible member connected to the shaft member. The flexible member is a film material that stirs the developer by rotation.

Further, it is known that the flexible member causes the developer to jump up from below to a portion in the casing where the supply port is formed by the elastic force of the flexible member.

In the developer container, it is necessary to prevent bridging of the developer. The bridging of the developer is a phenomenon in which the developer is condensed in a state where the developer straddles the supply port. The bridge of the developer blocks the supply of the developer to the developing unit.

While increasing the rotational speed of the rotating body is effective in preventing bridging of the developer, it becomes a factor that accelerates deterioration of the developer. Therefore, it is important to prevent bridging of the developer while suppressing the rotational speed of the rotating body. Further, it is desired to simplify the structure of the developer container.

SUMMARY

A developer container according to one aspect of the present disclosure includes a casing, a rotating shaft, a flexible member, and a rotating plate. The casing contains a powdery developer, and a supply port communicating with a supply destination of the developer is formed on a lower surface of the casing. The rotating shaft is rotatably supported by the casing and rotationally driven. The flexible member has a leading edge portion which is connected to the rotating shaft and turns through a region extending over the supply port on an inner lower surface of the casing when the flexible member is rotated in association with the rotating shaft. The rotating plate is formed to extend in a handguard-shape from a portion adjacent to the flexible member, has an outer edge portion along an edge of the supply port, and rotates in association with the rotating shaft.

An image forming apparatus according to another aspect of the present disclosure includes the developer container, a photosensitive member, a developing unit, and a transfer unit. The photosensitive member is a member having an electrostatic latent image formed on a surface thereof. The developing unit develops the electrostatic latent image by the developer supplied from the developer container. The transfer unit transfers an image on the surface of the photosensitive member to a sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments of the present disclosure will be described below with reference to the drawings. It should be noted that the following embodiments are merely examples of embodying the present disclosure and do not limit the technical scope of the present disclosure.

First Embodiment: Configuration of Image Forming Apparatus 10

A developer container 5 according to the first embodiment forms a part of an electrophotographic image forming apparatus 10.

The image forming apparatus 10 includes a print processing unit 4 for performing print processing. The printing process is a process for forming an image on the sheet 9. The sheet 9 is a sheet-like image forming medium such as paper or a resin film.

Figure 1:
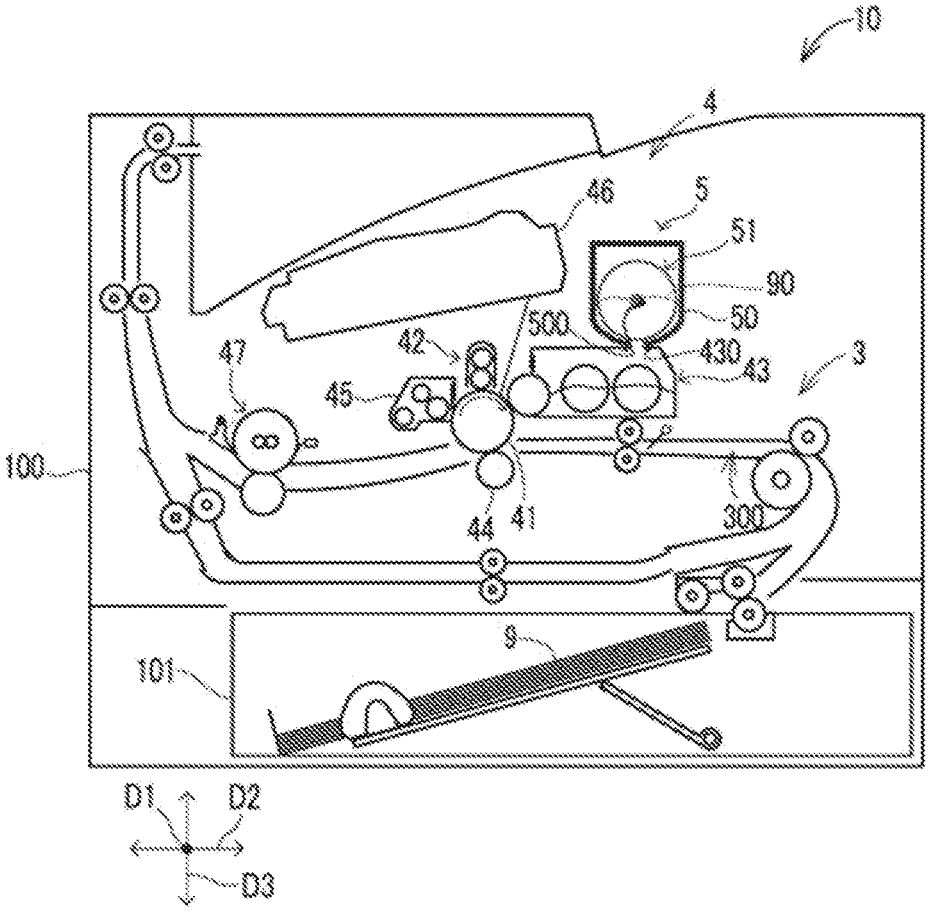
FIG. 1 is a configuration diagram of an image forming apparatus including a developer container according to the first embodiment.

As shown in FIG. 1, the image forming apparatus 10 includes a sheet conveying mechanism 3, a print processing unit 4, a developer container 5, and the like arranged in the main body 100.

The sheet conveying mechanism 3 sends out the sheet 9 accommodated in a sheet accommodating portion 101 to a sheet conveying path 300, and further transports the sheet 9 along the sheet conveying path 300.

The print processing unit 4 includes a photosensitive member 41, a charging device 42, a developing device 43, a transfer device 44, a cleaning device 45, an optical scanning unit 46, a fixing device 47, and the like.

The drum-shaped photosensitive member 41 rotates, and the charging device 42 charges the surface of the photosensitive member 41. The optical scanning unit 46 scans the surface of the charged photosensitive member 41 with a laser beam, thereby writing an electrostatic latent image on the surface of the photosensitive member 41. Thus, the electrostatic latent image is formed on the surface of the photosensitive member 41.

The developing device 43 develops the electrostatic latent image by supplying a powdery developer 90 to the surface of the photosensitive member 41. The developer 90 is a toner. The developing device 43 is an example of a developing unit that develops the electrostatic latent image by the developer 90 supplied from the developer container 5.

The transfer device 44 transfers the image of the developer 90 formed on the surface of the photosensitive member 41 onto the sheet 9 that is moving along the sheet conveying path 300. The transfer device 44 is an example of a transfer unit. The fixing device 47 fixes the image of the developer 90 on the sheet 9.

The cleaning device 45 removes the developer 90 remaining on the surface of the photosensitive member 41. The developer container 5 supplies the developer 90 to the developing device 43. The developer container 5 can be attached to and removed from the main body 100 of the image forming apparatus 10.

The developer container 5 includes a container case 50 for containing the developer 90 and a rotating body 51 rotatably supported in the container case 50. A supply port 500 communicating with a receiving port 430 of the developing device 43 is formed on the lower surface of the container case 50. The developing device 43 is a supply destination of the developer 90 by the developer container 5.

The rotating body 51 is rotationally driven in the container case 50 to agitate the developer 90. Further, the rotating body 51 sends the developer 90 from the supply port 500 of the container case 50 to the developing device 43. Thus, the developer 90 is supplied to the developing device 43 by natural falling.

It is necessary to prevent bridging of the developer 90 in the developer container 5. The bridging of the developer 90 is a phenomenon in which the developer 90 is condensed in a state of straddling the supply port 500. The bridge of the developer 90 prevents the supply of the developer 90 to the developing device 43.

Increasing the rotational speed of the rotating body 51 is effective in preventing the developer 90 from being bridged, but also causes the developer 90 to deteriorate faster. Therefore, it is important to prevent the developer 90 from bridging while suppressing the rotational speed of the rotating body 51. Further, it is desired to simplify the structure of the developer container 5.

The developer container 5 has a structure for preventing bridging of the developer 90 without increasing the rotational speed of the rotating body 51. Hereinafter, the structure of the developer container 5 will be described.

Configuration of Developer Container 5

Figure 2:
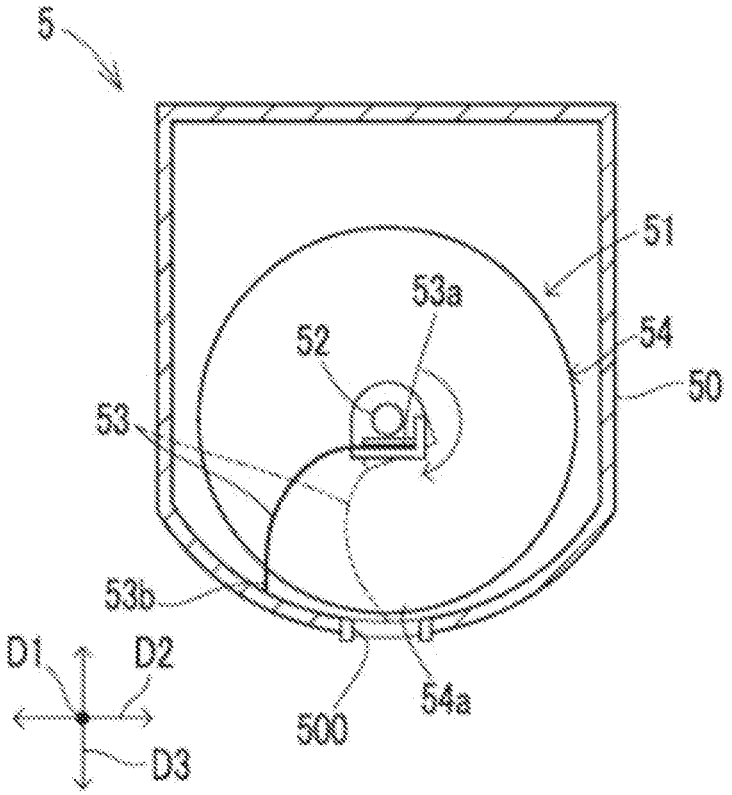
FIG. 2 is a configuration diagram of a developer container according to the first embodiment.
Figure 3:
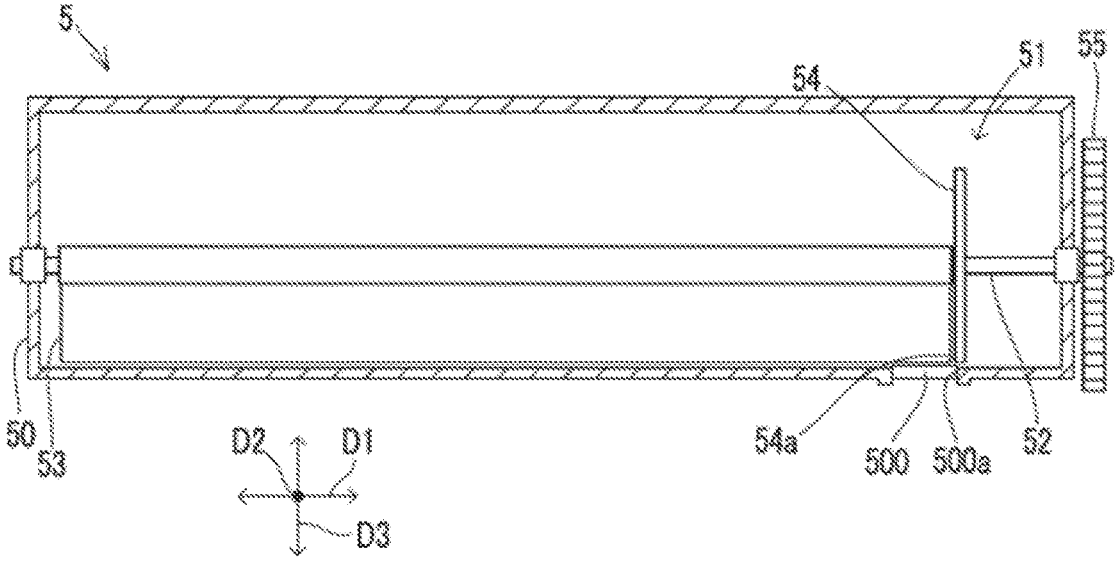
FIG. 3 is a partially cutaway front view of the developer container according to the first embodiment.

As shown in FIGS. 2 and 3, the rotating body 51 of the developer container 5 includes a rotating shaft 52, a flexible member 53, a rotating plate 54, and a gear 55. The rotating shaft 52 is rotatably supported by the container case 50.

In each of the drawings, a direction along the rotating shaft 52 is represented as an axial direction D1, a horizontal direction orthogonal to the axial direction D1 is described as a lateral direction D2, and a vertical direction is described as a longitudinal direction D3.

The gear 55 is connected to an end portion of the rotating shaft 52 outside the container case 50. The gear 55 receives a rotational force from a drive unit (not shown) disposed outside the container case 50. Thus, the rotating shaft 52 is rotationally driven by the driving unit.

The flexible member 53 is a film-like member mainly composed of synthetic resin such as PET (polyethylene terephthalate). Therefore, the flexible member 53 has flexibility. It is also conceivable that the flexible member 53 is a member formed by molding another synthetic resin such as vinyl chloride or polycarbonate into a film shape.

The flexible member 53 has a base edge portion 53*a* connected to the rotating shaft 52 and a leading edge portion 53*b* which is an edge portion opposite to the base edge portion 53*a*. The flexible member 53 rotates in association with the rotating shaft 52. The base edge portion 53*a* is a fixed end, and the leading edge portion 53*b* is a free end.

When the flexible member 53 rotates in association with the rotating shaft 52, the leading edge portion 53*b* rotates around the rotating shaft 52. The leading edge portion 53*b* turns through a region extending over the supply port 500 on the inner lower surface of the container case 50. The leading edge portion 53*b* turns while being in contact with the inner lower surface of the container case 50.

The flexible member 53 is rotated to agitate the developer 90. Further, when the leading edge portion 53*b* of the flexible member 53 turns along the supply port 500, the developer 90 in the container case 50 is sent out through the supply port 500.

The rotating plate 54 is connected to the rotating shaft 52. The rotating plate 54 is formed to extend in a handguard shape from a portion of the rotating shaft 52 adjacent to the flexible member 53. In this embodiment, the rotating plate 54 is formed in a disk shape orthogonal to the rotating shaft 52. The rotating plate 54 rotates in association with the rotating shaft 52.

The rotating plate 54 has an outer edge portion 54*a* along an outer edge 500*a* which forms one end in the axial direction D1 of the supply port 500.

The outer edge portion 54*a* of the rotating plate 54 separates the developer 90 present at the edge portion of the supply port 500. Further, even if the rotational speed of the rotating shaft 52 is slow, the rotating plate 54 continuously separates the developer 90. Therefore, the developer container 5 prevents bridging of the developer 90 without increasing the rotational speed of the rotating body 51.

Further, since the rotation of the rotating plate 54 has little influence on the agitation of the developer 90, the influence on the deterioration of the developer 90 is small. Further, even if the rotating plate 54 continues to rotate, the effect on the delivery of the developer 90 is small.

Further, the developer container 5 does not include a conveying screw, and the bridging of the developer 90 can be prevented by a simple structure.

Second Embodiment

Figure 4:
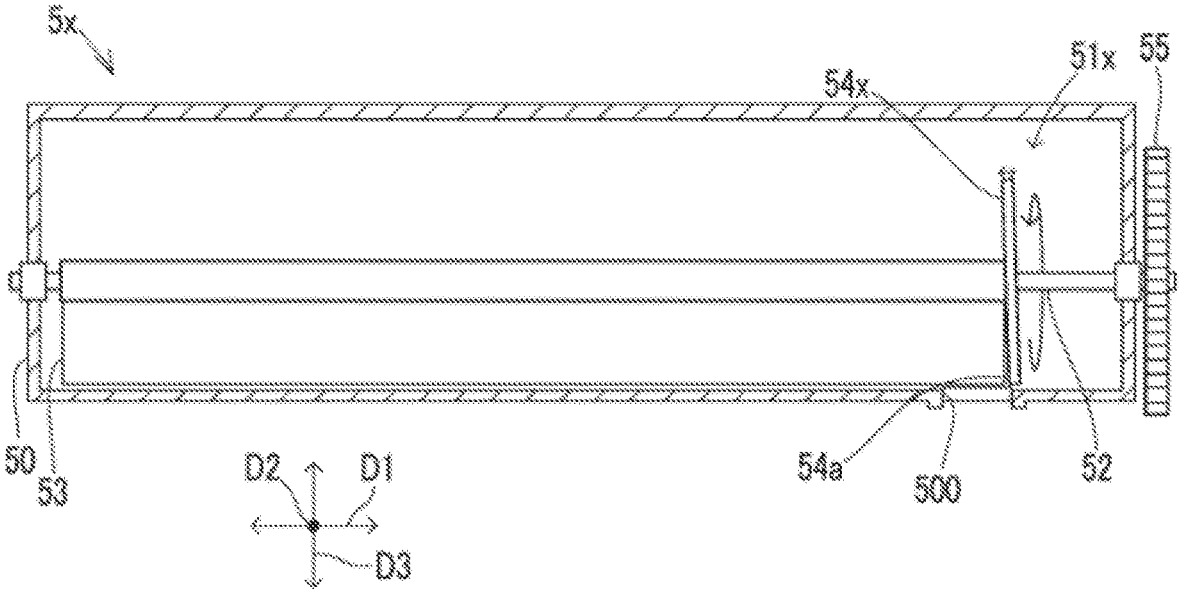
FIG. 4 is a partially cutaway front view of the developer container according to the second embodiment.

Next, the developer container 5*x* according to the second embodiment will be described with reference to FIG. 4. In FIG. 4, the same components as those shown in FIGS. 2 and 3 are denoted by the same reference numerals.

The difference between a developer container 5*x* and the developer container 5 will be described below. The developer container 5*x* has a structure in which the rotating plate 54 in the developer container 5 is replaced by a rotating plate 54*x*.

The rotating plate 54*x* is connected to the rotating shaft 52. The rotating plate 54*x* is formed to extend in a handguard shape from a portion of the rotating shaft 52 adjacent to the flexible member 53. In this embodiment, the rotating plate 54*x* is formed so as to be inclined with respect to a plane orthogonal to the rotating shaft 52.

The rotating plate 54*x* also has the outer edge portion 54*a* along the outer edge 500*a* of the supply port 500. The outer edge portion 54*a* of the rotating plate 54*x* swings in the axial direction D1 near the supply port 500. Therefore, the developer container 5*x* has a higher effect of separating the developer 90 present at the edge of the supply port 500.

Third Embodiment

Figure 5:
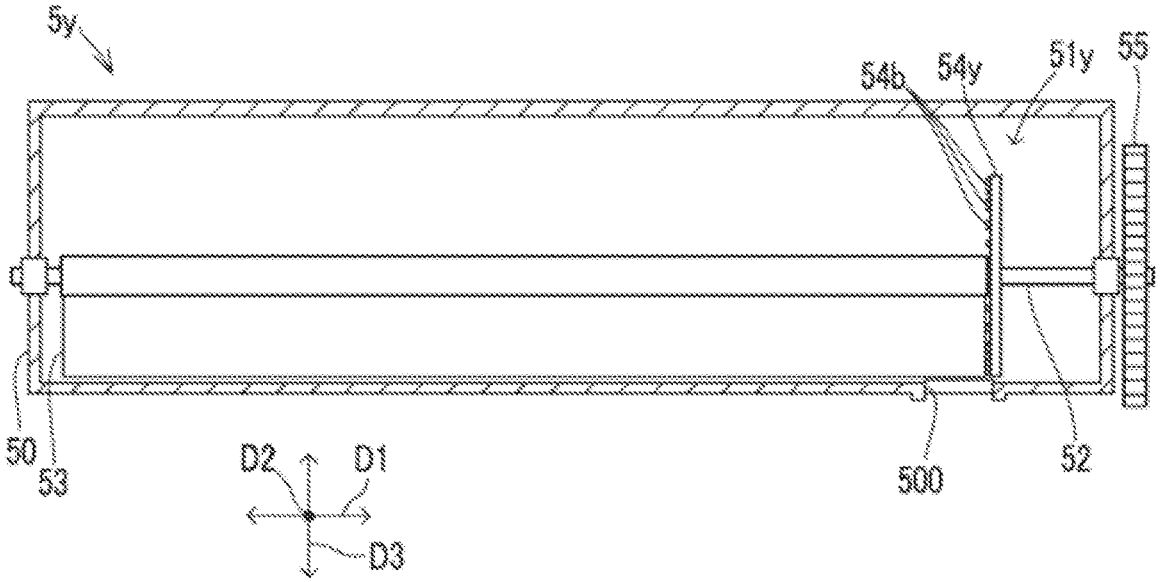
FIG. 5 is a partially cutaway front view of the developer container according to the third embodiment.
Figure 6:
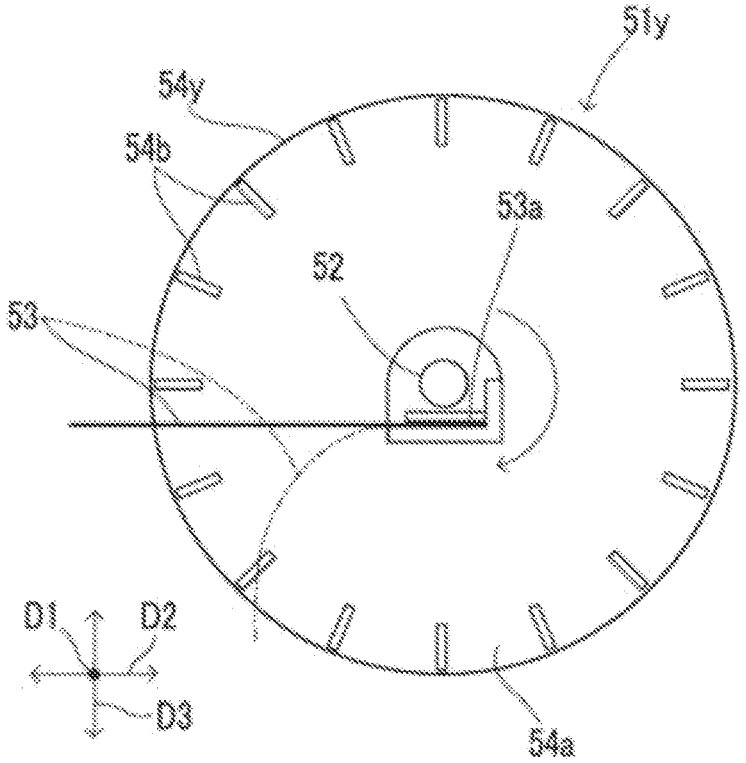
FIG. 6 is a front view of a rotating body in the developer container according to the third embodiment.

Next, a developer container 5*y* according to the third embodiment will be described with reference to FIGS. 5 and 6. In FIGS. 5 and 6, the same components as those shown in FIGS. 2 and 3 are denoted by the same reference numerals.

Hereinafter, differences between the developer container 5*y* and the developer container 5 will be described. The developer container 5*y* has a structure in which the rotating plate 54 in the developer container 5 is replaced by a rotating plate 54*y*.

The rotating plate 54*y* is connected to the rotating shaft 52. The rotating plate 54*y* is formed to extend in a handguard shape from a portion of the rotating shaft 52 adjacent to the flexible member 53.

In this embodiment, a plurality of convex portions 54*b* arranged in the circumferential direction are formed on the surface of the outer edge portion 54*a* of the rotating plate 54*y* on the supply port 500 side. Thus, the surface of the outer edge portion 54*a* of the rotating plate 54*y* on the supply port 500 side is formed in an uneven shape.

Since the rotating plate 54*y* has a plurality of convex portions 54*b*, the developer container 5*y* has a higher effect of separating the developer 90 existing at the edge of the supply port 500. The rotating plate 54*y* may be applied to the developer container 5*x*.

Fourth Embodiment

Figure 7:
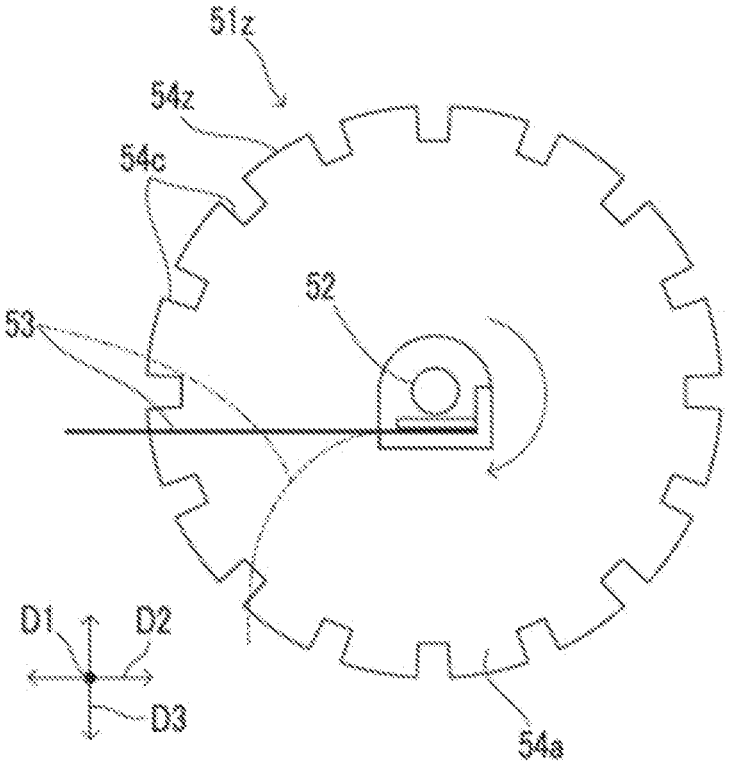
FIG. 7 is a front view of a rotating body in the developer container according to the fourth embodiment.

Next, the developer container according to the fourth embodiment will be described with reference to FIG. 7. In FIG. 7, the same components as those shown in FIGS. 2 and 3 are denoted by the same reference numerals.

Differences of the present embodiment from the developer container 5 will be described below. The developer container in this embodiment has a structure in which the rotating plate 54 in the developer container 5 is replaced by a rotating plate 54*z*.

The rotating plate 54*z* is connected to the rotating shaft 52. The rotating plate 54*z* is formed to extend in a handguard shape from a portion of the rotating shaft 52 adjacent to the flexible member 53.

In this embodiment, a plurality of concave portions 54*c* arranged in the circumferential direction are formed on the outer edge portion 54*a* of the rotating plate 54*z*. As a result, the outer edge portion 54*a* of the rotating plate 54*y* is formed in an uneven shape in the circumferential direction.

By adopting the present embodiment, it is possible to realize a developer container having a higher effect of separating the developer 90 existing at the edge of the supply port 500. The rotating plate 54*z* may be applied to the developer container 5*x*.

What is claimed is:

1. A developer container comprising;

a casing containing a powdery developer and having a supply port formed on a lower surface thereof, the supply port communicating with a supply destination of the developer;

a rotating shaft rotatably supported by the casing and rotationally driven;

a flexible member connected to the rotating shaft and having a leading edge portion that turns through a region extending over the supply port on an inner lower surface of the casing when the flexible member rotates in association with the rotating shaft, and a rotating plate which is formed so as to protrude in a handguard-shape from a portion of the rotating shaft adjacent to the flexible member, has an outer edge portion along an edge of the supply port, and rotates in association with the rotating shaft.

2. The developer container of claim 1, wherein a plurality of convex portions arranged in a circumferential direction of the rotating plate are formed on a surface of the outer edge portion of the rotating plate at the supply port side.

3. The developer container of claim 1, wherein a plurality of concave portions arranged in a circumferential direction of the rotating plate are formed in the outer edge portion of the rotating plate.

4. The developer container of claim 1, wherein the rotating plate is formed so as to be inclined with respect to a plane orthogonal to the rotating shaft.

5. An image forming apparatus comprising;

the developer container of claim 1;

a photosensitive member having an electrostatic latent image formed on a surface thereof;

a developing unit developing the electrostatic latent image by the developer supplied from the developer container, and a transfer unit transferring the image on the surface of the photosensitive member onto a sheet.

* * * * *